United States Patent [19]

Bennewitz

[11] Patent Number: 4,463,234

[45] Date of Patent: Jul. 31, 1984

[54] TACTILE FEEL MEMBRANE SWITCH ASSEMBLY

[75] Inventor: William W. Bennewitz, Milwaukee, Wis.

[73] Assignee: Centralab Inc., Milwaukee, Wis.

[21] Appl. No.: 548,066

[22] Filed: Nov. 2, 1983

[51] Int. Cl.[3] ..... H01H 13/48; H01H 13/52

[52] U.S. Cl. ..... 200/159 B; 200/5 A

[58] Field of Search ..... 200/5 A, 159 B, 67 D

[56] References Cited

U.S. PATENT DOCUMENTS

| | | | |
|---|---|---|---|
| 4,129,758 | 12/1978 | Gilano et al. | 200/159 B |
| 4,207,448 | 6/1980 | Furusawa et al. | 200/159 B |
| 4,254,309 | 3/1981 | Johnson | 200/159 B |

OTHER PUBLICATIONS

IBM Technical Disclosure Bulletin "Switch", Harris et al., vol. 12 No. 7, Dec. 1969, p. 1130.

*Primary Examiner*—John W. Shepperd

*Attorney, Agent, or Firm*—Jack E. Haken; James J. Cannon, Jr.

[57] ABSTRACT

A switch is disclosed having an insulating substrate with a first contact, a spacer layer with a hole aligned with the contacts, a flexible membrane with second contacts aligned with the hole and first contact, the membrane having a raised area of controlled thickness aligned with the second contact forming a force actuator, a dome enclosure with circular pockets for locating snap domes aligned with the raised area of the membrane, an overlay with cut out portions corresponding, to the snap domes and an overlay with graphic indicia covering the assembly.

1 Claim, 3 Drawing Figures

TACTILE FEEL MEMBRANE SWITCH ASSEMBLY

BACKGROUND OF THE INVENTION

1. Field of the Invention

This invention pertains to a membrane switch assembly in which the movement of at least one flexible membrane closes the switch contacts. In membrane switches of the mechanical type, the movement of a flexible membrane simultaneously causes the movement of a conductive member to bridge and close the normally open switch contacts. The membrane movement is typically provided by light finger pressure which moves an internal conductive member through a small gap to close the switch. The present invention includes a further provision for providing tactile and audible feedback to the operator of the switch, while retaining the planar construction and thickness parameters of prior art membrane switches.

2. Description of the Prior Art

In the construction of one type of membrane switch, one or both of the switch contacts is incorporated into an insulative substrate which may comprise a film base or a circuit board panel. The underside of a flexible upper membrane, which overlies the substrate and is spaced apart from the contacts thereon includes a conductive member which may be the other of the switch contacts or a conductive bridge, either of which is adapted to close the contacts upon depression of the flexible membrane. In either case there is a small air gap or space between the contact area of the substrate and the conductive underside of the flexible membrane in the normally open position of the switch. Such constructions are shown, for example, in U.S. Pat. Nos. 3,898,421; 4,365,130 and 4,284,866.

The problem of tactile or audible feedback in the membrane switch has been recognized for some time. The typical membrane switch operation requires a very light force, and a very small deflection to make a contact. Without any type of feedback (visual, audible or tactile) many operators have difficulty sensing switch closure.

One solution to the problem of tactile feel has been the introduction of a dome, either metal or heat formed plastic, which is flexible and which has a certain snap as it is depressed. Some switch designs have incorporated the metal snap domes as active contact members of the switch, acting as shorting pads. Other prior art designs have used an embossed plastic bubble rather than a metal dome. This has been done on the overlay of the membrane switch or on a separate layer between the membrane and the overlay. The plastic bubble concept often produces undesirable tactile characteristics because it does not uniformly deflect over its entire area. Since the bubble does not deform consistently toward the center, an undesirable "teasing" effect may occur. Switch teasing is undesirable because the operator may receive an acceptable tactile feel response, but yet the switch may not close properly. The present invention incorporates a force actuator to reduce any teasing possibilities.

Other methods of producing tactile feel exist but they are difficult to apply in planar construction. Conductive rubber switching can be molded into many different force vs. deflection profiles. However, these molded actuators have package profiles much greater than the typical 0.030"-0.040" membrane switch. Plastic bubbles are often integrated with molded buttons to provide a rigid plunger for actuating the bubble. The button stem acts like a force actuator concentrating the switch force. The drawback to button designs, is also inherent in their non-planar package height. The intent of the present invention is to provide tactile feedback within present membrane thickness parameters.

SUMMARY OF THE INVENTION

In the present invention a membrane switch or a plurality of membrane switches in a keyboard array are provided with tactile feel by the provision of a metal snap dome and a force actuator positioned above the membrane switch. The tactile feel is provided by a sudden decrease in force during actuation of the switch. In the present invention, a snap dome, a force actuator, a dome enclosure and an overlay are mounted above the membrane switch. These are all provided with a planar, layered construction which with selective placement of adhesive to hold the layers in position enables the metal dome to be free to deflect through its specified travel. The full travel of the metal dome will provide acceptable tactile feel response. When the dome snaps through, it engages a force actuator which forces the membrane down causing the switch contacts to close.

DESCRIPTION OF THE PREFERRED EMBODIMENT

Figure 1:
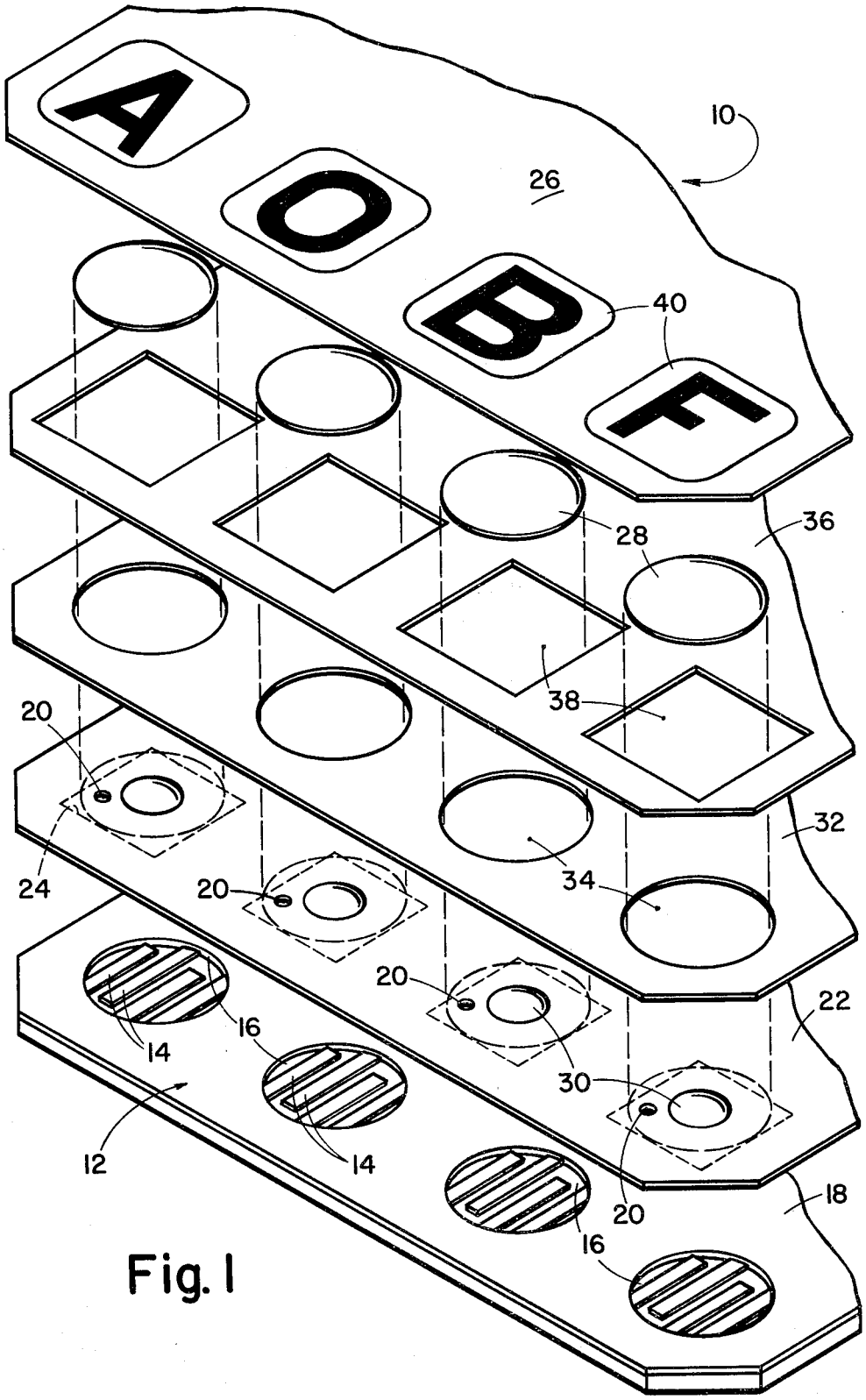
FIG. 1 is an exploded view of the membrane switch of the present invention in a keyboard array, including the snap dome and force actuator which provide tactile feel in the present invention.

FIG. 1 shows a portion of a typical 16-key membrane switch panel or keyboard 10. Referring particularly to FIG. 1, the various components of the panel 10 are shown in an exaggerated exploded view, since the very thin sections and positions of many of the components make it difficult to show them accurately in an ordinary full section. The basic keyboard panel 10 includes a conventional p.c. board/spacer assembly 12 as the bottom substrate in the disclosed embodiment. Alternatively, the substrate may comprise a thin plastic film. The substrate typically includes a sheet of polyester with a thickness of 5 to 7 mils. (0.013 to 0.018 mm.), which may be attached by a suitable lower adhesive layer to a backup board or, alternately, directly to a control panel (not shown).

On the upper surface of the substrate, a pattern of conductive switch contacts and leads is applied by silk screening a thin layer of conductive paint, such as silver. In the embodiment shown, a pair of contacts 14 is located at each switch position. The contacts 14 of each switch are thus normally open. In the conventional construction, a lead extends from each contact to a terminal on a flexible tail which comprises an integral extension of the substrate. One of the leads is typically common and includes a connection to one contact 14 of each switch pair. A spacer 18 overlies the substrate assembly 12 and is attached thereto by a thin layer of an adhesive (not shown) applied to the surface of the spacer. The spacer 18 may be made from any suitable insulating material, a polyester plastic being the preferred material. The spacer material is typically about 5 mils. (0.13 mm.) in thickness and the adhesive layer about 1 mil. (0.025 mm.). A series of apertures 16 is provided in the spacer 18, one aperture being disposed at the position of each pair of switch contacts 14. The apertures 16 are interconnected with a network of internal vent channels 20 (shown partially in membrane 22) which, like apertures 20 are cut completely through the thickness of the spacer material. The vent channels may be of any width adequate to provide the venting required, as disclosed in U.S. Pat. No. 4,365,130.

Overlying the spacer 18 is a flexible membrane 22 which comprises a movable member for closing the various pairs of switch contacts 14. The flexible membrane 22, like the substrate 12 and the spacer 18 is preferably made of a polyester film. The flexible membrane has a thickness in the range of from 5 to 7 mils. (0.13 to 0.18 mm.), which thickness results from a compromise providing mechanical springback and toughness to resist puncturing or other damage and flexibility to provide a light touch sensitivity. The flexible membrane 22 may be attached to the spacer 18 by a thin layer of adhesive (not shown) applied to the upper surface of the spacer.

A series of thin conductive bridges 24 (FIGS. 2 and 3) is screened, preferably using silver paint, on the underside of the flexible membrane 22. Other suitable conductive materials and other methods of attaching them to the membrane may also be used. Each conductive bridge 24 is aligned with an aperture 16 and a spacer 18 and is thus also aligned with but normally separated from a pair of switch contacts 14. In the embodiment shown, the conductive bridge 24 has a rectangular shape just slightly smaller than the aperture 16, but large enough to span substantially all of a pair of switch contacts 14 which it overlies.

Figure 2:
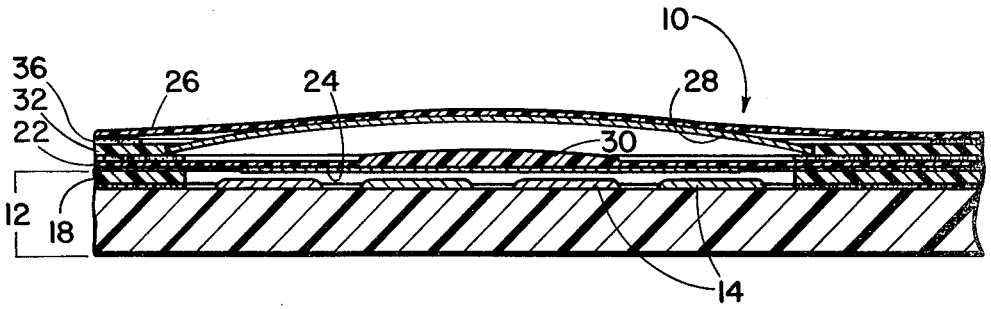
FIG. 2 is a cross-sectional view of the membrane switch of the present invention before actuation.
Figure 3:
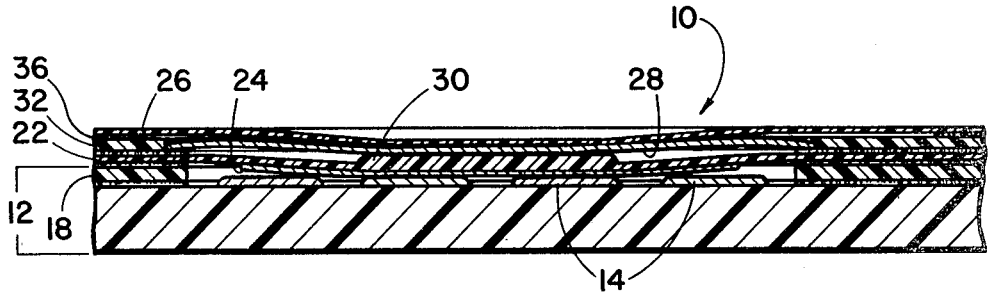
FIG. 3 is a cross-sectional view of the membrane switch of the present invention during actuation.

The description of the preferred embodiment so far is that of a membrane switch as disclosed in the prior art and in particular as disclosed in U.S. Pat. No. 4,365,130. Such a typical prior art membrane switch would be completed by the addition of graphics 26 or other indicia suitably applied to the upper surface of the flexible membrane, as shown in FIGS. 1 and 2 of that prior art patent. The graphics may be applied by screening or with a thin adhesive-backed layer. They also may be applied to the underside of a transparent flexible membrane prior to the screening thereon of the conductive bridges 24.

The novelty of the present invention lies in the layers inserted between the graphics layer 26 and the flexible membrane 22.

Returning to the prior art, a completely operative switch panel 10 is provided by the adhesive lamination of the three basic parts, namely, the lower substrate 12 with the screened contacts 14 and leads; the intermediate spacer 18 with the apertures 16 and vent means 20, and the upper flexible membrane 22 with the conductive bridges 24. In some embodiments it may be desirable to mount the switch panel to a backup board. In addition, the enclosure of the panel may be completed by the use of a bezel, not shown, which overlies the flexible membrane 22, encloses the edges of the laminated panel and is attached to the backup board. The bezel includes openings in the surface thereof at each switch position to facilitate finger actuation of the individual switches and to conveniently separate them.

In operation, a membrane switch is closed by depressing the flexible membrane 22 and causing the conductive bridge 24 to be deflected through the aperture 16 and the spacer 18 and to span and connect the fitting fingers of the pair of contacts 14. The distance through which the membrane must be moved is very small, comprising essentially only the thickness of the spacer 18 which in the embodiment described is 5 mils. (0.13 mm.). Short travel distance is the source of the problem to which the present invention is directed. The typical membrane switch operation requires a very light force (from 2 to 8 ounces) and a very small deflection (0.007 inches) to make contact. Without any type of feedback (visual, audible, or tactile), many operators have difficulty sensing the switch closure. The present invention incorporates a metal dome to provide a tactile feel (and a slight audible feedback) to a membrane switch. As described hereinafter, the provision in the present invention of a tactile feel by means of a dome 28 inserted between the flexible membrane 22 and the indicia on the graphic layer 26 combined with the force actuator 30 described below provides a significant improvement over existing membrane switch designs with tactile feel, while preserving a planar construction within a conventional membrane switch profile.

The major point of novelty in the present invention is that the invention positions a metal dome 28 above the membrane switch providing tactile feel within present membrane thickness parameters. Therefore it does not effect the composition of the original switch design. Additionally, as described hereinafter, the present invention provides a force actuator 30 on the top surface of the flexible membrane 22 to help transmit the actuation force to the membrane layer 22.

Given the prior art membrane switch assembly, minus the graphic overlay 26, the present invention first provides a force actuator 30 on the upper side of flexible membrane 22. The force actuator 30 is a small circular layer having a diameter significantly less than the diameter of the apertures 16 provided in spacer 18. The force actuator has a height of 0.005 inches and is deposited on the upper side of the flexible membrane 22. It is centered such that it will be under the center of the tactile snap dome 28 to be installed above the membrane switch.

The invention is further realized in that between the graphic overlay 26 and the flexible membrane 22 having a force actuator 30 deposited thereon, there are inserted in the construction a number of layers. The first layer is a dome enclosure 32 which is a polyester film approximately 0.007 inches in thickness with adhesive on its lower side and in which are positioned one or more circular cutouts 34, each cut out 34 corresponding to and aligned with a membrane switch pattern, each cut out 34 forming a circular pocket for locating domes 28 during assembly. A metal snap dome 28 is inserted in each dome enclosure pocket 34. An overlay adhesive layer 36 is then applied to the dome enclosure layer. The overlay adhesive layer is 0.005 inches in thickness and has patterns 38 cut therethrough, each pattern corresponding to the pattern of a key 40 on the graphic overlay 26. These patterns are arranged such that no adhesive is placed over the top of the various metal domes 28. The graphic overlay 26 is then assembled and adheres to the overlay adhesive layer 36. The overlay adhesive layer 36 serves to bond the overlay 26 to the dome enclosure 32 which completes the assembly.

Due to the layer construction and the selective placement of the adhesive, the metal dome 28 is free to deflect through its specified travel. This is a key element in providing acceptable tactile feel response. When the dome 28 snaps through, the force actuator 30 forces the membrane down, causing the contacts to close.

In the present invention, the dome 28 remains free to move through its appropriate deflection and produce the desirable click associated with an over-center mechanism. Mounting a metal snap dome 28 and providing a force actuator 30 above the membrane switch gives the operator a tactile feel, that is a sudden decrease in force, during actuation, while retaining a planar construction.

Some variations of the preferred embodiment are possible. The force actuator 30 is a controlled thickness dot or area located on top of the membrane 22. In the preferred embodiment, a screenable U.V. dielectric material is used and this material is built up to the required thickness. Any other conformable layer, material, or attached piece could be used to perform the actuator function. However, life expectancy requirements demand a material that will not deform, delaminate or degrade over time.

The metal dome 28 could be replaced by an embossed plastic bubble. This could be done on the adhesive overlay or a separate layer between the membrane and the overlay. The plastic bubble concept may exhibit undesirable life characteristics and therefore is not preferred.

The concept of the present invention can be applied to a film base membrane switch construction or a rigid base membrane switch construction.

The particular construction of the present invention provides a tactile feel which is an improvement over existing designs. The operator will experience a distinct force change while hearing the dome snap through. In addition, the tactile feel is integrated as an option in the present construction without affecting the basic planar membrane switch construction and thickness profile. That is because the present invention positions the metal dome and the force actuator above the membrane switch, not affecting the composition of the original switch design. The fact that the metal dome is not an electrically functional member can be an advantage. If failure of the metal dome may occur (due to abuse or excessive switch cycling) the membrane switch should remain functional. The switch would continue to operate much like a regular membrane switch, but with a slightly higher force and no tactile feel. Metal domes mounted on a P.C. board switch would probably fail in a catastrophic continuous shorting mode. Plastic bubbles with silver screened on the bottom side might crack or deform in a fashion which would render the switch useless. Providing the force actuator on the top surface of the membrane helps transmit the actuation force to the membrane layer. The dome remains free to move through its appropriate deflection and produce the desirable click associated with over the center mechanisms. The provision of the force actuator element improves both the feel and the audible response of the switch assembly, while eliminating "teasing". The force actuator also limits the dome travel to prevent overstressing of the dome due to excessive deflection. The optional nature of the extra layers in the membrane switch allows the tactile feel option to be designed into membrane switches as required.

I claim:

1. In a membrane switch assembly of the type including an insulating substrate having attached to its inner surface first conductive contact portions of at least one switch; and insulated spacer layer overlying and secured to said substrate and having at least one aperture therein, said aperture providing open access to the conductive contact portion of at least one of said switches; and a flexible membrane overlying and secured to said spacer layer and having attached to its inner surface second conductive contact portions of said switches, each of said second conductive contact portions being disposed in alignment with one of said apertures and said first conductive contact portions and spaced from the latter such that each of said switches is normally open, the improvement comprising:

a force actuator comprising a raised area of controlled thickness located on the top of said flexible membrane and centered within an area defining said second conductive contact portions on the opposite side of said membrane such that said controlled thickness area is disposed in alignment with one of said apertures and in a plane above said aperture;

said controlled thickness area serving as a force actuator;

a dome enclosure layer with an adhesive on one side and having at least one circular pocket cut out therein for locating each dome during assembly, said dome enclosure layer being secured to and positioned above said flexible membrane layer such that said controlled thickness area is centered within said circular pocket cutout;

a metal snap dome positioned inside said dome enclosure pocket;

an overlay adhesive layer positioned above said dome enclosure layer and having portions cut out corresponding to the position of said dome; and an overlay having graphic indicia thereon for each switch position covering said entire assembly and secured to the top of said overlay adhesive.

* * * * *